United States Patent [19]

Elsel

[11] 4,418,325

[45] Nov. 29, 1983

[54] SUPPORT STRUCTURE FOR TRANSMITTING LARGE FORCES

[75] Inventor: Werner Elsel, Erlangen, Fed. Rep. of Germany

[73] Assignee: Siemens Aktiengesellschaft, Munich, Fed. Rep. of Germany

[21] Appl. No.: 281,935

[22] Filed: Jul. 10, 1981

[30] Foreign Application Priority Data

Jul. 21, 1980 [DE] Fed. Rep. of Germany ..... 3027616

[51] Int. Cl.[3] ..... H01F 1/00; F24H 3/00

[52] U.S. Cl. ..... 335/216; 174/15 CA; 174/17 VA; 165/47

[58] Field of Search ..... 335/216; 174/15 CA, 174/17 VA; 165/47

[56] References Cited

U.S. PATENT DOCUMENTS

| | | | |
|---|---|---|---|
| 3,980,981 | 9/1976 | Boom et al. | 335/216 |
| 3,996,545 | 12/1976 | Elsel et al. | 335/216 X |
| 4,066,991 | 1/1978 | Martson et al. | 335/216 |
| 4,379,275 | 4/1983 | Elsel | 335/216 |

OTHER PUBLICATIONS

"IEEE Transactions on Magnetics," vol. Mag-11, No. 2, Mar. 1975, pp. 475-488.

*Primary Examiner*—William R. Cline
*Assistant Examiner*—S. Gayle Dotson
*Attorney, Agent, or Firm*—Kenyon & Kenyon

[57] ABSTRACT

A support structure for transmitting large forces between a superconducting magnet winding which is cooled to a very low temperature and an abutment which is at a higher temperature level and takes up the forces, especially in an energy storage device, contains support elements which point, at least approximately, in the direction of force transmission and between which stiffening elements are attached, and at least one sheet-like heat shield. This support structure has high buckling stiffness and nevertheless results in low losses due to heat transfer by making all support elements and all stiffening elements of the support structure of a really extended design formed in a honeycomb-like structure and using at least one plane of stiffening elements to form the heat shield which is kept at a predetermined intermediate temperature by means of a coolant conducted through cooling canals. In the stiffening elements of the heat shield parts of a material with high thermal conductivity such as wires of copper, are advantageously arranged.

11 Claims, 3 Drawing Figures

SUPPORT STRUCTURE FOR TRANSMITTING LARGE FORCES

BACKGROUND OF THE INVENTION

This invention relates to superconducting windings in general and more particularly to a support structure for transmitting the large forces generated in such a winding.

A support structure for transmitting large forces between a superconducting magnet winding cooled to a very low temperature and an abutment body which is at a higher temperature level and takes up the forces, utilizing support elements which point at least approximately in the direction of the force transmission and between which stiffening elements are attached, and having at least one heat shield extending over an area is described in U.S. Pat. No. 3,980,981. Such support structures are required particularly for inductive, superconducting storage devices. The great advantage of such storage devices is seen in the fact that with them, energies on the order of magnitude of $10^{12}$ joule or more can be stored in a relatively small volume, energy densities of about 10 joule/$cm^3$ being obtained with magnetic flux densities of about 5 Tesla. Flux densities of such magnitude can be achieved economically in magnet windings only by means of so-called technical Type-II superconductors such as niobium-titanium (Nb—Ti), niobium-tin ($Ni_3Sn$) or vanadium gallium ($V_3Ga$). Such storage devices generally contain a number of coaxial solenoids of these conductors, into which the electric energy is fed during low load periods of many hours via inverters from a connected network. At peak load times, the required energy can then be given off again to the network over a period of minutes or hours.

According to one proposal for such a superconducting energy storage device, with which several gigawatt-hours can supposedly be stored, three magnet windings are provided, each of which has a diameter of between 120 and 150 m, is 4 to 5 m wide and 8 to 10 m high. These windings are to be fabricated in situ in tunnels which are driven into the rock ("IEEE Transactions on Magnetics", Vol.MAG-11, No. 2, March 1975, pages 475 to 488).

The forces emanating from the superconducting winding of a magnetic gigawatt storage device such as Lorentz forces can be in the order of $10^{11}$ Newton. It must be possible to transmit these very large forces safely by a support structure between the superconducting magnet winding and an outer abutment which takes up the forces and for which, especially for cost reasons, natural rock is provided. In addition, a prime requirement for a support structure suitable for this purpose is that the terminal losses caused by it due to heat influx through a solid body must be kept as low as possible, since the economic feasibility of a superconducting energy storage device is determined, in particular, also by these heat losses.

These requirements are supposedly also met by the support structure described in U.S. Pat. No. 3,980,981. According to one embodiment, this support structure contains columnar support elements which extend radially outward with respect to the axis of the superconducting magnet winding approximately in the direction of the force transmission. These support elements are furthermore mutually guyed by wires to provide a sufficiently strong support structure. (FIG. 1) Also, pairs of support elements can have their ends facing the magnet winding engaging a common support point, so that they represent the two legs of an A-shaped support arrangement. The support elements of such a support arrangement are furthermore held in a firm mutual position by stiffening elements extending transversely to the bracing direction. (FIG. 3) In addition, thermal radiation shields which extend as surfaces approximately concentrically about the magnet winding and consist of metallic surfaces and superinsulation, are provided in the known support structures.

It was found, however, that these known support structures, even those with A-shaped supports, have only relatively low buckling strength. In order to prevent buckling of the supports under load, the supports of the known support structure must then have a sufficiently large material cross section. This, however, leads to correspondingly large losses due to heat inflow to the parts of the storage device which are cooled to the lowest temperature.

It is therefore an object of the present invention to design a support structure of the kind mentioned at the outset in such a manner that the large forces occurring in a superconducting energy storage device can be transmitted safely by it and the heat losses due to solid body heat inflow via the support cross section are nevertheless relatively small.

SUMMARY OF THE INVENTION

According to the present invention, this problem is solved by providing all support elements and all stiffening elements in sheet form such that they form a honeycom-like structure, and with at least one plane of stiffening elements forming the heat shield which is kept at a predetermined intermediate temperature in a manner known per se by means of a coolant conducted through cooling canals.

The advantages of this design of a support structure are in particular that its heat conducting support cross section, which is designed in view of the permissible compression, tension and shear stresses, can be kept relatively small because of the honeycomb form. In addition, a large portion of the heat flux transmitted via the support structure can be removed by a suitable coolant at the plane or planes of stiffening elements which serve at the same time as a heat shield. The heat losses due to solid body heat inflow can therefore be limited to a relatively small amount.

DETAILED DESCRIPTION

Figure 1:
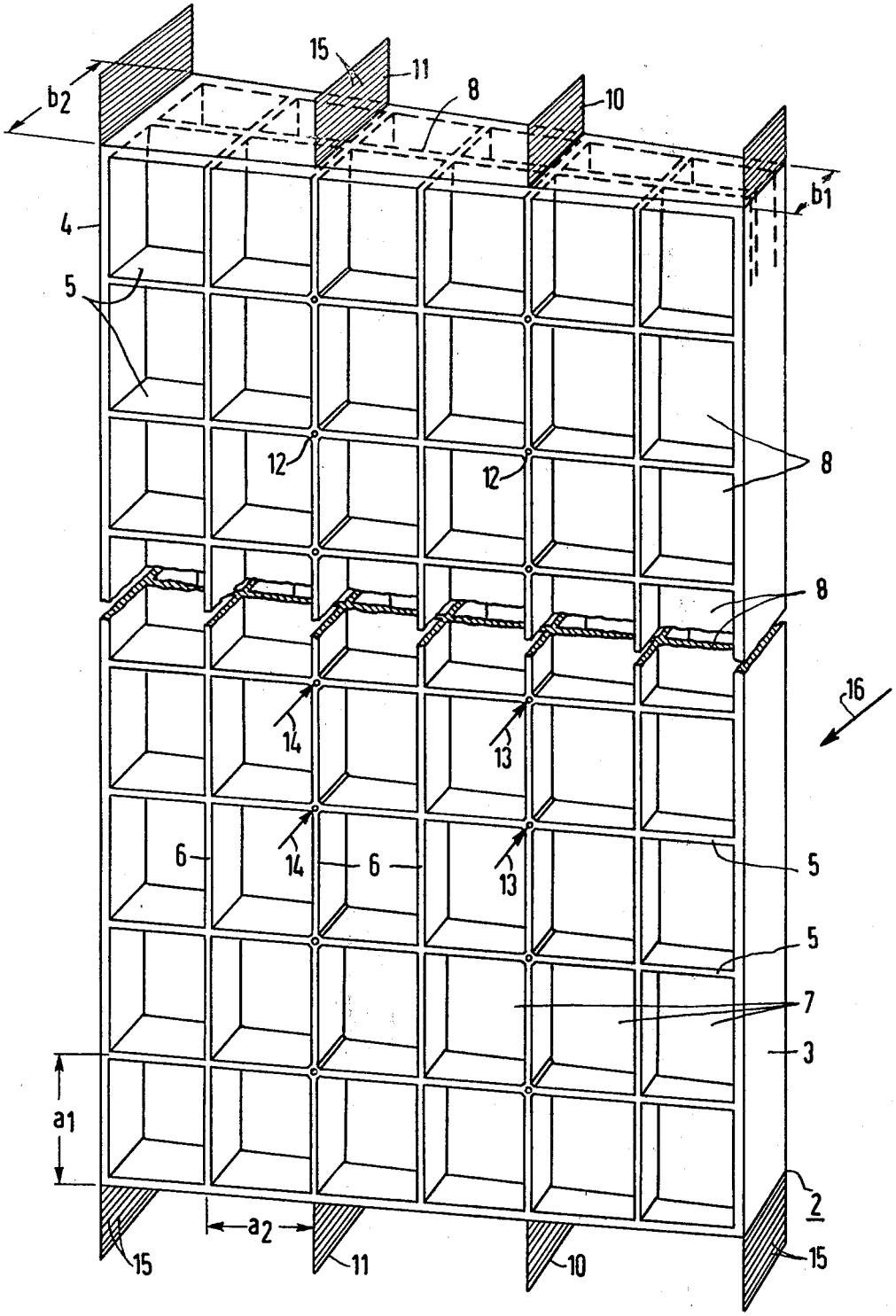
FIG. 1 is a schematic illustration of an embodiment of a support structure according to the present invention.

The support structure which is shown in FIG. 1 in an oblique view and is generally designated with 2, is to serve for transmitting forces between a superconducting magnet winding of an energy storage device, which is to be cooled to a very low temperature but is not shown, and an abutment which is approximately at room temperature. The abutment takes up the forces and may be, in particular, rock. The side of the support structure 2 resting against the magnet winding is therefore at the low temperature of, say, 1.8 K., while its base 4 resting against the abutment is therefore approximately at ambient temperature of, for instance, 300 K. The support structure contains a multiplicity of sheet-like support elements 5 which are arranged parallel to each other at a mutual spacing $a_1$ and extend at least approximately in the direction of the force transmission. Each support element is of approximately trapezoidal shape; its inner cold side has the width $b_1$ and its outer base the width $b_2$. The parallel planes of the support elements 5 which extend in the direction of the force transmission are penetrated orthogonally by planes of stiffening elements 6 which extend at least approximately perpendicular to the direction of the force transmission. The parallel planes of these stiffening elements are likewise approximately equally spaced from each other by an amount $a_2$.

The support elements 5 and stiffening elements 6 are firmly connected to each other and form a common, honeycomb-like structure with rectangular honeycombs 7. To further stiffen this honeycomb structure, honeycombs 7 can contain at least one further stiffening plane which points in the direction of the force transmission and extends perpendicular with respect to the planes of the support elements 5 and the stiffening elements 6. According to the figure, a single such stiffening plane is provided in the form of a central wall 8 of the structure 2.

A fiberglass reinforced plastic, and in particular, an epoxy matrix is advantageously provided as material for the structure 2.

In the support structure according to the present invention, individual planes formed by the stiffening elements 6 advantageously also serve at the same time as heat shields, inasmuch as they are kept, in a manner known per se, at predetermined constant temperature levels. According to the embodiment of FIG. 1 two planes 10 and 11 are provided as heat shields which are kept, for instance, by one or more coolants at about 10 K. and 70 K., respectively. For this purpose, holes are provided or tubes 12 are let in within the support structure along the intersections, at which the planes of the support elements 5 and the stiffening elements 6 intersect, through which the coolant streams indicated by arrows 13 and 14 are conducted.

To improve the heat conduction of these transverse planes 10 and 11, which also serve as a heat shield, with a constant temperature level, as well as of the plane 3 resting against the magnet winding and the outer warm plane 4 which rests against the abutment, special bodies of a thermally highly conductive material such as copper as embedded into these parts of the support structure. Suitable heat conducting bodies are, for instance, wires 15 or also ribbons or fabrics. This measure ensures that the planes 3, 4, 10 and 11 are at predetermined, at least approximately constant temperature levels.

An arrow 16 in FIG. 1 indicates the resultant total force acting on the support structure 2 which adjusts itself when the storage device is in operation.

Since the support structure 2 has high buckling stiffness and shear strength due to its honeycomb structure, there is no danger that it will buckle under the action of a large force. The heat inflow from the warm abutment to the magnet winding is nevertheless relatively small since the heat conducting support cross section which is designed in view of the permissible compression, tensile and shear stresses, is relatively small.

The support structure shown in FIG. 1 can be fabricated, for instance, by placing honeycomb-like elements of predetermined thickness and geometry which are adapted to the action directions of the winding forces, on the front and back side of a continuous sheet serving as the central plate 8, so that as little heat conduction as possible is ensured.

Figure 2:
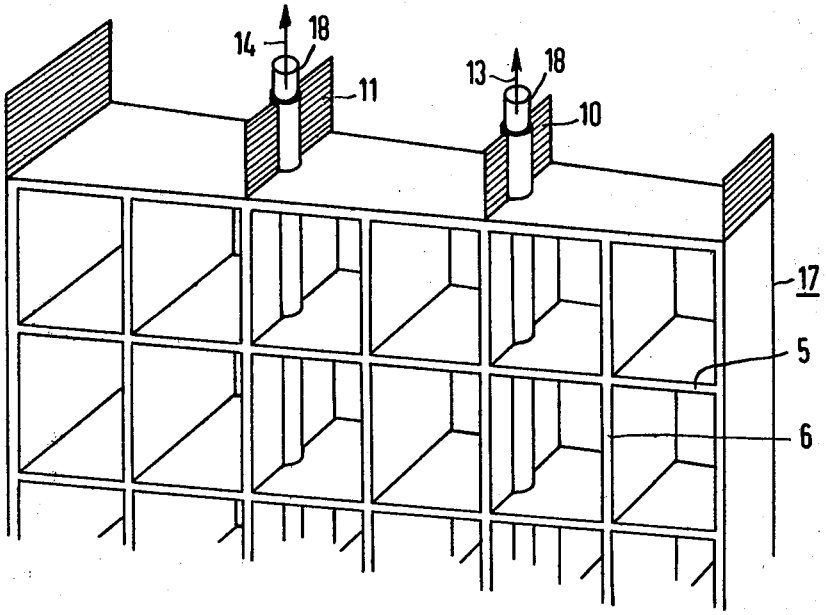
FIG. 2 shows part of a further such support structure.

In FIG. 2, another support structure 17 according to the present invention is indicated in part and in an oblique view. Parts identical with those in FIG. 1 are designated with the same reference symbols. Contrary to the support structure 2, according to FIG. 1, the cooling tubes 18 of the support structure 17 do not extend along the planes 10 and 11 acting as heat shields with constant temperature level in the direction of the intersection of these planes with the planes of the support element 5, but extend along these planes orthogonally to the planes of the support elements. As can be seen from a comparsion of this support structure 17 with the support structure 2 according to FIG. 1, a stiffening central plane 8 used in FIG. 1 and which points in the direction of the force transmission, can optionally be dispensed with.

In the support structure according to FIGS. 1 and 2, it was assumed that the honeycombs of these structures have, at least approximately, rectangular shape. However, honeycombs which are not rectangular can also be provided. Besides the shape of the honeycombs, the thickness of the individual honeycomb walls can also be adapted to the flow of the force, where advantageously the material properties are utilized to the stress limits. In general, the outer bounding surfaces of the support structures will have greater thickness than their inner honeycomb walls.

Figure 3:
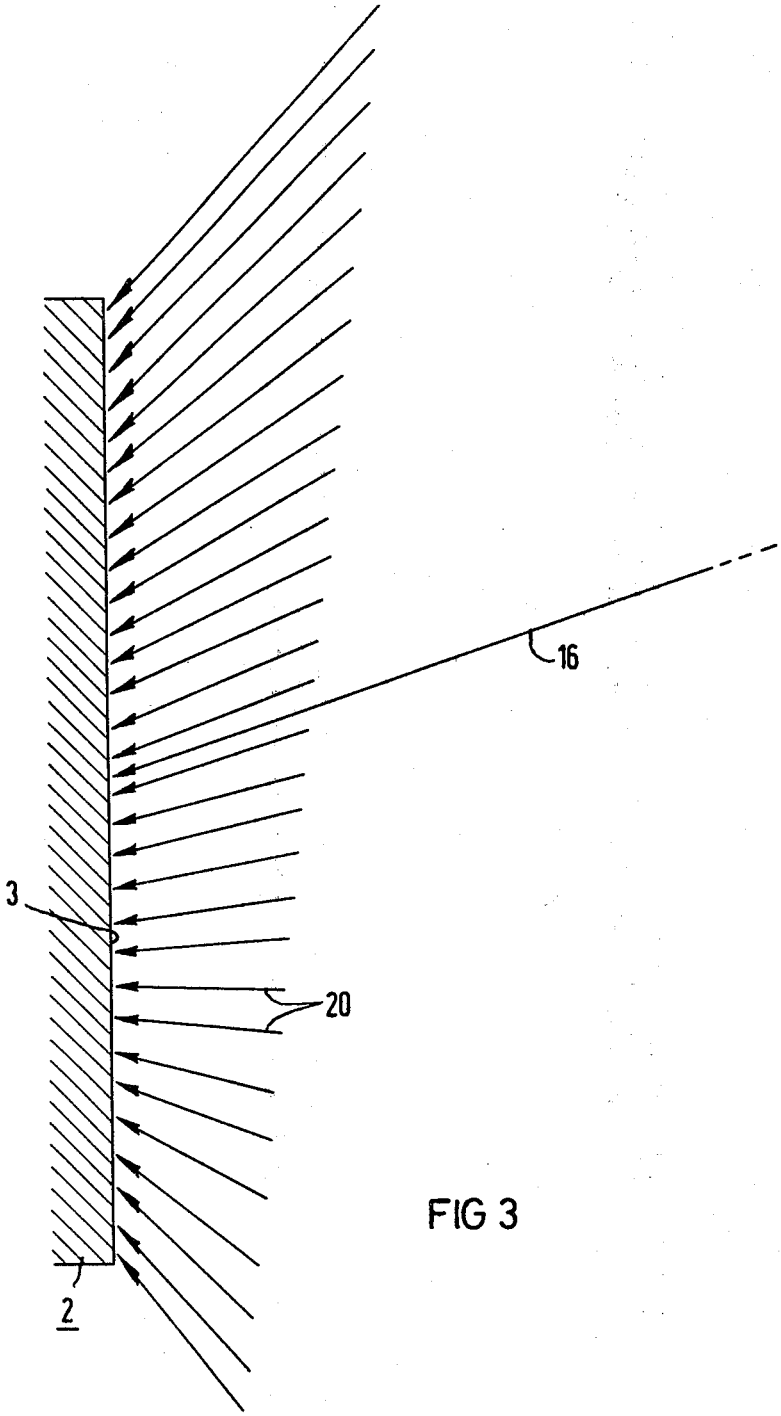
FIG. 3 illustrates a typical force load of such a support structure.

According to an actual embodiment of the support structure 2 shown in FIG. 1 made of fiberglass reinforced epoxy, the sides 3 and 4, the two outer support elements 5 as well as the central plane 8 each have a thickness of 18 mm, while the other parts of the support structure are 10 mm thick. The dimension in the direction of the force transmission is about 1.2 m, the spacing between the planes 4, 11, 10 and 3 being about 40 cm. The entire support structure perpendicular to the direction of the force transmission is about 3.85 m long, the spacing $a_1$ between adjacent support elements 5 being about 24 cm. On the ambient temperature side, the support structure has a width $b_2$ of about 40 cm and on the low temperature side a width $b_1$ of about 20 cm. With this support structure, the forces indicated in FIG. 3 can be transmitted without any danger of the structure buckling under load. The forces which act on the support structure 2 indicated in the figure in a side view and are illustrated by arrows 20 are typical for an energy storage device with superconducting magnet windings of the order of magnitude mentioned at the outset. The total force indicated by an arrow 16 can then be about $2\times10^7$ Newton, while the individual force components indicated by arrows 20 are between $5\times10^5$ and $1.5\times10^6$ Newton.

What is claimed is:

1. In a support structure, for transmitting large forces, between a superconducting magnet winding cooled to a low temperature and an abutment which is at a higher temperature level and takes up the forces, including support elements which point at least approximately in the direction of the force transmission, stiffening elements attached, between the support elements and at least one sheet-like heat shield, the improvement comprising:

all support elements having the shape of sheets and arranged in a honeycomb-like structure;

at least one plane of stiffening elements forming the heat shield; and a coolant conducted through cooling canals holding said at least one plane at a predetermined intermediate temperature.

2. The improvement according to claim 1, wherein said support elements and stiffening elements are made of fiberglass reinforced plastic.

3. The improvement according to claim 2, wherein said support elements and stiffening members are made of fiberglass reinforced epoxy.

4. The improvement according to claim 1 wherein cooling tubes forming said cooling canals are integrated in the support structure.

5. The improvement according to claim 4, comprising holes in the support structure acting as cooling tubes.

6. The improvement according to claim 4 wherein said cooling tubes run at the intersections between the stiffening elements and the support elements.

7. The improvement according to claim 4, wherein said cooling tubes are arranged perpendicular to the support elements.

8. The improvement according to claim 2 and further including heat conducting parts of a material with high thermal conductivity in the stiffening elements of the heat shield.

9. The improvement according to claim 8, wherein said heat conducting parts are wires or ribbons or screens of copper.

10. The improvement according to claim 1 comprising at least one integrated stiffening plane in the direction of the force transmission perpendicular to the planes of the support elements and stiffening elements.

11. The improvement according to claim 10, wherein the stiffening plane is a central wall of the structure.

* * * * *